US005509817A

United States Patent [19]

Tsuji

[11] Patent Number: 5,509,817

[45] Date of Patent: Apr. 23, 1996

[54] CONNECTOR HAVING SHORT CIRCUIT TERMINAL

[75] Inventor: Takeshi Tsuji, Yokkaichi, Japan

[73] Assignee: Sumitomo Wiring Systems Ltd., Mie, Japan

[21] Appl. No.: 240,484

[22] Filed: May 10, 1994

[30] Foreign Application Priority Data

May 12, 1993 [JP] Japan ..... 5-135365

[51] Int. Cl.[6] ..... H01R 13/703

[52] U.S. Cl. ..... 439/188; 200/51.1

[58] Field of Search ..... 439/188, 489, 439/490; 200/51.1

[56] References Cited

U.S. PATENT DOCUMENTS

| | | | |
|---|---|---|---|
| 4,850,888 | 7/1989 | Denlinger et al. | 439/188 |
| 4,904,196 | 2/1990 | Sueyoshi et al. | 439/188 |
| 5,064,973 | 11/1991 | Zinn et al. | 439/188 |
| 5,131,865 | 7/1992 | Taguchi et al. | 439/489 |

FOREIGN PATENT DOCUMENTS 1-77287 5/1989 Japan .

*Primary Examiner*—Neil Abrams
*Attorney, Agent, or Firm*—Oliff & Berridge

[57] ABSTRACT

A short-circuit terminal mounted within an air bag-side housing includes contact portions that are formed respectively at opposite side portions thereof and are resiliently and selectively engaged with respective ones of a pair of female terminals. A narrow insulating plate that can intrude between one of the contact portions of the short-circuit terminal and an upper surface of one of the female terminals is mounted within a power source-side housing within which male terminals are provided. When the two housings are fitted together, the insulating plate intrudes between one contact portion of the short-circuit terminal and its associated female terminal, thereby interrupting an electrical connection between the pair of female terminals. With this construction, it is possible to reduce a manipulation force required for inserting and withdrawing a connector provided with a short-circuit terminal, and the connector will not trigger erroneous opening of the air bag.

20 Claims, 2 Drawing Sheets

CONNECTOR HAVING SHORT CIRCUIT TERMINAL

BACKGROUND OF THE INVENTION

This invention relates to an improved connector provided with a short-circuit terminal for short-circuiting open terminals connected to an operating device so that current may not accidentally flow into the operating device when the fitting between male and female connector housings is released.

Air bags have been increasingly used for protecting passengers against the impact of a car crash. An operating circuit for such an air bag is formed by connecting terminals connected to an igniter for a gas-generating agent to terminals connected to a power source via an impact sensor. When an impact sensor detects a car collision, current flows to the igniter to ignite the gas-generating agent to produce a large amount of gas, thereby inflating the air bag.

Although the air bag needs to be positively operated in the event of a collision, the air bag must be prevented from being erroneously operated when there is no collision. For example, the connection between the connectors can be released during the installation of the air bag and during inspection. At these times, terminals within an air bag-side connector housing become open. However, there is a risk that a magnetic field or an electric field produced around the open terminals could induce a voltage to develop between the open terminals so that current could flow into the igniter of the air bag, thus causing the above-mentioned erroneous operation.

In the conventional connector, when the two connector housings are to be fitted together, an insulating plate is thrusted into two contact portions between a short-circuit terminal and a pair of terminals. In order to push together the connector housings of the conventional connectors, it is necessary to overcome a large frictional resistance associated with the insulating plate in addition to the already existing frictional resistance required to be overcome when connecting the terminals of the two. housings together. Therefore, conventional connectors have encountered a drawback that a large manipulation force is required for the insertion and withdrawal of one housing relative to the other, thus providing difficult operability. Moreover, since a large load must be overcome when the housings are to be fitted together, there is a possibility that the housings are inadvertently retained in an incompletely-fitted condition, and in such a case, there is a risk that an incomplete connection between the corresponding terminals may be encountered, thus failing to achieve a proper electrical connection.

The above disadvantages may arise not only in the connector for an air bag, but also in those connectors with a short-circuit terminal for other applications.

SUMMARY OF THE INVENTION

The present invention has been made in view of the above problems, and an object of the invention is to provide a connector in which a fitting operation can be carried out easily and smoothly.

Another object of the present invention is to provide a connector that prevents erroneous operation of air bag inflation. More specifically, a pair of terminals connected to an igniter and a short-circuit terminal of an electrically-conductive material that resiliently contacts the pair of terminals are provided within an air bag-side connector housing, whereas terminals connected to a power source, as well as an insulating plate adapted to intrude between the short-circuit terminal and the pair of terminals (with which the short-circuit terminal is resiliently contacted) when the two connector housings are fitted together are provided within a power source-side connector housing. With this construction, when the two housings are not fitted together, the short-circuit terminal resiliently contacts the pair of terminals within the air bag-side housing to prevent a potential difference from developing between the pair of terminals to thereby prevent current from accidentally flowing into the igniter, thus preventing an erroneous operation. When the housings are fitted together, the insulating plate intrudes between the short-circuit terminal and the pair of terminals to interrupt an electrical connection between the pair of terminals, and by doing so, short-circuiting is prevented from occurring when current flows into the igniter side.

The above object of the present invention has also been achieved by a connector having a first (male or female) connector housing including at least a pair of first terminals connected to an operating device, an opening and a resiliently biased short-circuit terminal made of an electrically-conductive material that is interruptably engageable with the pair of first terminals. The first connector can be fitted together with a second connector; and the second connector includes a pair of second terminals connected to a power source for the operating device, as well as an insulating plate, which when the first and second connector housings are fitted together, can intrude between the short-circuit terminal and one of the pair of first terminals with which the short-circuit terminal is resiliently engageable.

When the two connector housings are fitted together, the insulating plate mounted within the power source-side housing intrudes between the short-circuit terminal mounted within the operating device-side housing and one of the pair of terminals with which the short-circuit terminal is resiliently contacted, thereby interrupting an electrical connection between the pair of terminals.

For interrupting an electrical connection between the pair of terminals, the insulating plate is caused to intrude between the short-circuit terminal and only one of the pair of terminals with which the short-circuit terminal is resiliently engaged. With this construction, a frictional resistance produced by this intruding operation can be kept to a low level, and the manipulation force required for fitting and withdrawing the connector housings relative to each other can be reduced, thereby enhancing the efficiency of the operation.

Furthermore, since the load applied when fitting the housings together is reduced, there is no risk that the housings are retained in an incompletely-fitted condition, thereby eliminating the possibility of an incomplete connection between the terminals, so that the electrical connection can be positively secured when necessary.

BRIEF DESCRIPTION OF THE DRAWINGS

The invention will be described in detail with reference to the following drawings wherein.

DETAILED DESCRIPTION OF PREFERRED EMBODIMENTS

Figure 1:
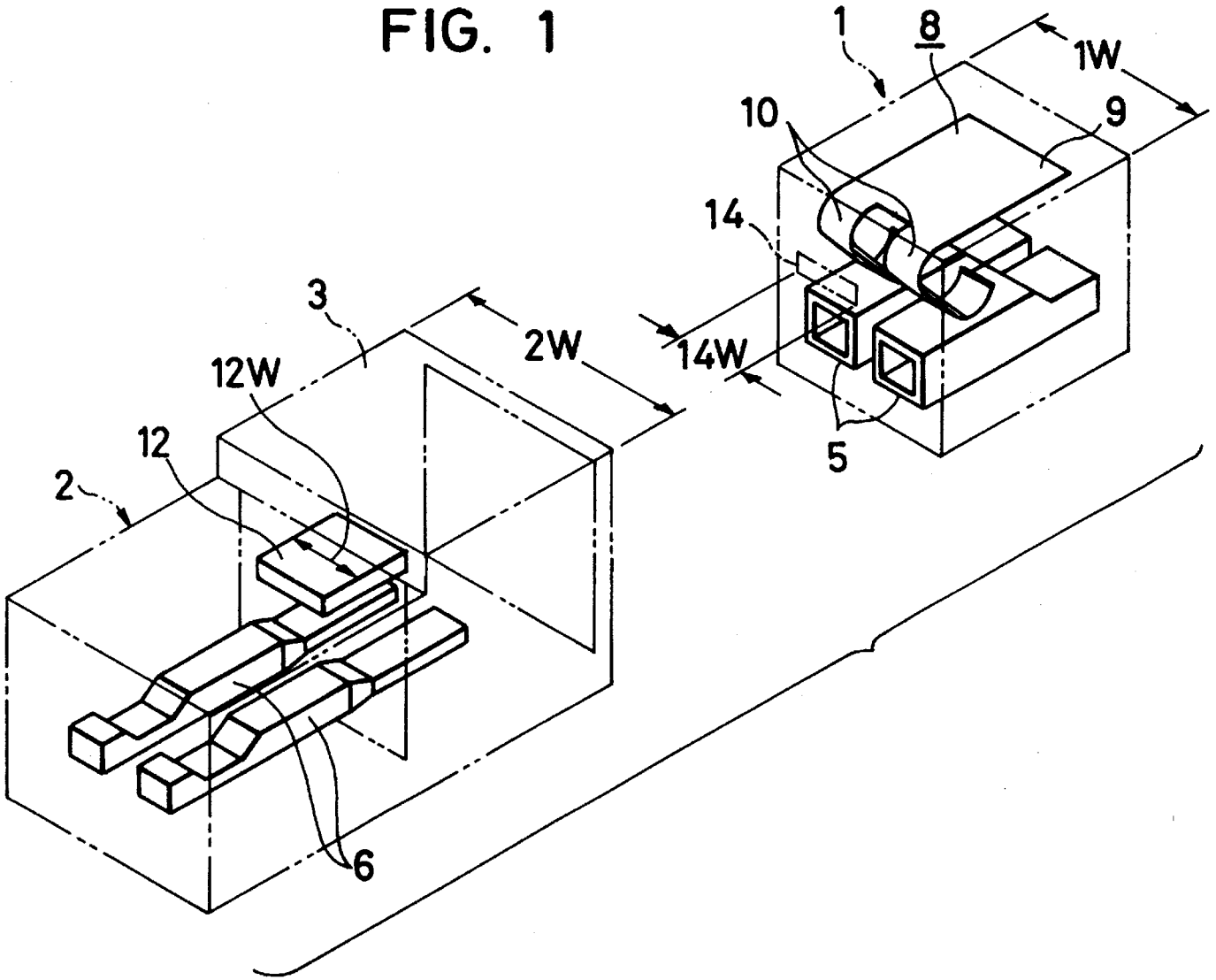
FIG. 1 is a perspective view showing the connector housings of a preferred embodiment of the present invention.

One preferred embodiment of a connector of the present invention will now be described with reference to FIGS. 1, 2(A) and 2(B). The description relates to a connector for an air bag, however, the invention is not meant to be limited thereto.

In the drawings, reference numeral 1 denotes an air bag-side connector housing, and reference numeral 2 denotes a power source-side connector housing. By inserting the air bag-side housing 1 into a larger-width portion 3 provided at a front side of the power source-side housing 2, the two housings are connected together in a fitted position.

A pair of female terminals 5, which are connected to respective ends of signal wires (not shown), which in turn are connected to an igniter (not shown) for igniting a gas-generating agent (not shown) of an air bag, are fitted in the air bag-side housing 1 at a bottom portion thereof and are juxtaposed laterally to provide a space therebetween. A pair of male terminals 6 connected to respective ends of signal wires connected via an impact sensor to a power source provided within a car are fitted in the power source-side housing 2 at a bottom portion thereof. The pair of male terminals 6 are adapted to intimately fit in the respective female terminals 5.

A short-circuit terminal 8 adapted to short-circuit the pair of female terminals 5 is provided within the air bag-side housing 1 at an upper portion thereof. The short-circuit terminal 8 is in the form of a resilient, electrically-conductive plate and includes a base plate portion 9 overlying the two female terminals 5 and contact portions 10 extending from a front edge of the base plate portion 9 at opposite side portions thereof. Each contact portion 10 includes a pick-up or a front end portion 10*a* in the shape of a saddle that is resiliently urged toward one of the respective female terminals 5. The base plate portion 9 is fixedly secured to a top wall of the housing 1, and the contact portions 10 are always urged into contact with upper surfaces of the female terminals 5, respectively, by virtue of their inherent resiliency.

Figure 2A:
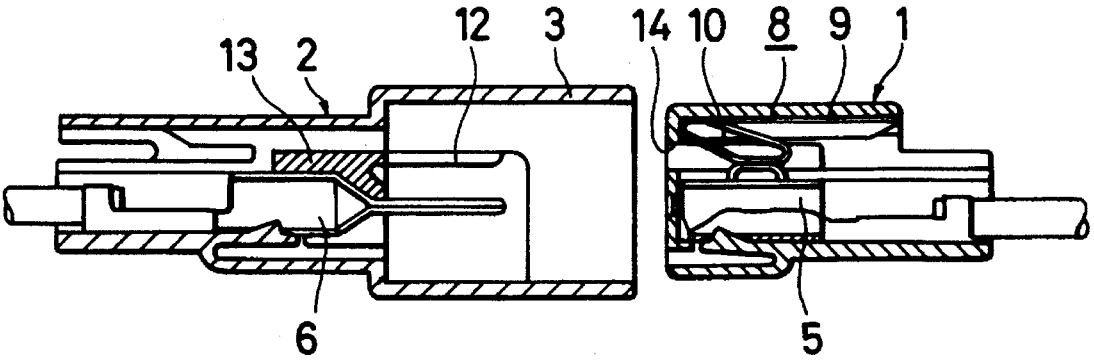
FIG. 2(A) is a cross-sectional view showing a condition of the connector housings prior to the fitted condition.
Figure 2B:
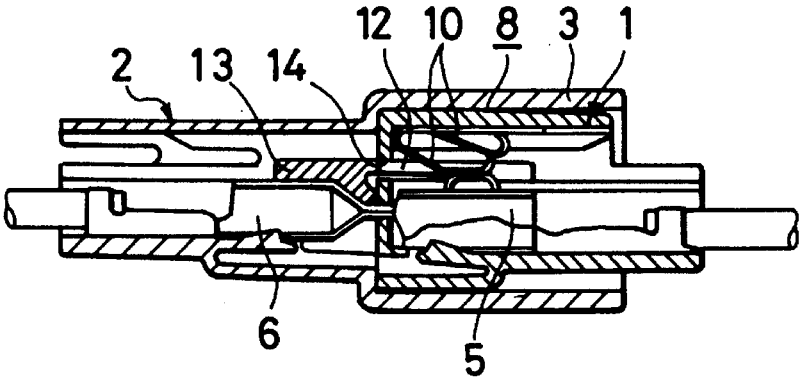
FIG. 2(B) is a cross-sectional view showing a condition of the connector housings in the fitted condition.

As shown in FIGS. 1, 2(A), and 2(B), the power source-side housing 2 is provided with an insulating or interruption plate 12 of a narrow width that projects from a front edge of a base plate 13 (FIGS. 2A and 2B) preferably formed integrally with and extending between opposite side walls of the housing 2. The width 12*w* of the insulating plate and the insulating plate's greatest dimension is less than half the width 2*w* of the housing 2. The insulating plate 12 can intrude between one of the resiliently urged front end portions 10*a* and the upper surface of the associated female terminal 5. An opening 14 for allowing the insertion of the insulating plate 12 is formed in the front face of the air bag-side housing 1. The opening 14 is registered with the insulating plate 12 and has a width 14*w* equal to the width 12*w* of the insulating plate and about half a width 1*w* of the housing 1.

The operation and effects of this embodiment of the above construction will now be described.

When the two connector housings 1 and 2 are disengaged during air bag installation inspection, the two contact portions 10 of the short-circuit terminal 8 resiliently contact respective ones of the pair of female terminals 5 within the air bag-side housing 1, as shown in FIG. 2(A). This prevents a potential difference from developing between the two female terminals 5, therefore preventing current from accidentally flowing into the igniter and erroneous ignition of the air bag.

When the housings 1 and 2 are fitted together, the male terminals 6 are connected to the respective female terminals 5, and the insulating plate 12 provided on the power source-side housing 2 is inserted into the air bag-side housing 1 through the opening 14, as shown in FIG. 2(B). As a result, the insulating plate 12 intrudes between one of the contact portions 10 of the short-circuit terminal 8 and the upper surface of the female terminal 5 with which the one contact portion 10 is resiliently contacted in such a manner that the insulating plate resiliently deforms the one contact portion 10. Therefore, the electrical connection between the pair of female terminals 5 is interrupted, thereby preventing accidental short-circuiting from occurring when current is supplied from the power source to the igniter in the event of a collision.

Thus, in this embodiment, for interrupting the electrical connection between the pair of female terminals 5, the insulating plate 12 is caused to intrude between only one contact portion 10 of the short-circuit terminal 8 and its associated female terminal 5. Moreover, it is not necessary to disengage both contact portions from their associated female terminal portions. With this construction, a frictional resistance is smaller as compared with the case where the insulating plate is caused to intrude between two contact portions and two female terminals. Therefore, the manipulation force required for fitting and withdrawing the connector housings 1 and 2 relative to each other is reduced.

Furthermore, since the load applied when fitting the housings 1 and 2 together is reduced, there is less risk that the housings 1 and 2 are retained in an incompletely-fitted condition, thereby eliminating the possibility of an incomplete connection between the male and female terminals 6 and 5, so that the electrical connection can be positively secured when necessary.

While the invention has been described in detail with reference to preferred embodiments thereof, which are intended to be illustrative and not limiting, various changes may be made without departing from the spirit and scope of the invention. For example, the present invention is not limited to the connector of the above embodiment for an air bag, but can also be applied extensively to connectors of all types that comprise a short-circuit terminal for short-circuiting open terminals of an operating device when the fitting of connector housings is released so that current will not accidentally flow into the operating device.

What is claimed is:

1. A connector comprising a first connector housing and a second connector housing, said first connector housing having a first pair of terminals connected to an operating device and a short-circuit terminal having at least two adjacent contact portions that are resiliently biased in substantially a common direction, said short circuit terminal being made up of an electrically-conductive material, each of said contact portions being interruptably engageable with said first pair of terminals, said second connector housing being engageable with said first connector housing and connected to a power source for said operating device, said second connector housing having an insulating plate that intrudes between said short-circuit terminal and only one of said pair of first terminals with which said short-circuit terminal is resiliently engaged when said first and second connector housings are fitted together while at least one of said contact portions remains engaged to its associated terminal.

2. A connector comprising:

a first housing having a first pair of terminals, a short circuit terminal having two adjacent contact portions that are resiliently biased in substantially a common direction towards respective ones of said first pair of terminals, said first housing also having an opening aligned between only one of said two adjacent contact portions and only one associated terminal; and a second housing having a second pair of terminals and an insulating plate;

wherein said first housing and said second housing are engaged with each other in a connected position and are disengaged in an unconnected position and wherein said insulating plate is insertable within said opening in said connected position to render said short circuit terminal inoperative by biasing said only one of said pair of contact portions away from said only one associated terminal while at least one of said contact portions remains engaged to its associated terminal.

3. The connector according to claim 2, wherein said opening has a width of about half a width of the first housing.

4. The connector according to claim 4, wherein a greatest dimension of said insulating plate is less than half a width of said second housing.

5. The connector according to claim 2, wherein said short circuit terminal includes a base connected between said first housing and said pair of contact portions for resiliently and interruptably engaging respective ones of said first pair of terminals.

6. The connector according to claim 5, wherein, in said connected position, one of said pairs of contact portions is engaged with one of said first pair of terminals and the only one of said pair of contact portions is engaged with said insulating plate.

7. The connector according to claim 5, wherein said pair of contact portions comprises leaf springs biased toward said first pair of terminals in said common direction.

8. The connector according to claim 5, wherein said pair of contact portions is made from an electrically conductive material.

9. A connector comprising a first housing and a second housing, said first and second housings each having terminals adapted to be engageable with each other in a fitted condition; a first one of said first housing or said second housing having a short circuit terminal having at least two adjacent contact portions each of which is resiliently biased in substantially a common direction towards an associated terminal, and a second one of said first housing or said second housing having an interruption plate for biasing only one of said contact portions, in a direction opposite said common direction, away from a first said associated terminal while at least a second said associated terminal is maintained in engagement with said short circuit terminal.

10. The connector according to claim 9, wherein said first one of said first housing and said second housing further comprises an opening that is registered with said interruption plate in said fitted condition.

11. The connector according to claim 10, wherein said interruption plate has a length that is no greater than half a length of said short circuit terminal.

12. The connector according to claim 9, wherein said short circuit terminal comprises a base to which each of said contact portions, is attached.

13. The connector according to claim 12, wherein said base and said contact portions are made from an electrically conductive material.

14. The connector according to claim 9, wherein said short circuit terminal comprises a base and said contact portions comprise a pair of electrical pick-ups each of which contacts an associated terminal.

15. The connector according to claim 14, wherein in said fitted condition, a first of said pair of pick-ups engages one of said associated terminals and a second of said pair of pick-ups is disengaged from a second of said associated terminals.

16. The connector according to claim 15, wherein said second of said pair of pick-ups engages said interruption plate.

17. A connector comprising a pair of terminals mounted in a first housing, a short circuit terminal having a base fixedly attached to said first housing and a pair of adjacent contact portions resiliently biased in a common direction towards respective ones of said pair of terminals, and a single opening on a face of said first housing aligned between only a first terminal of said pair of terminals and a first associated contact portion, a second terminal of said pair of terminals and a second associated contact portion not being in communication with said single opening such that said second terminal cannot be disengaged with the second associated contact portion.

18. The connector according to claim 17, further comprising a second housing having a pair of terminals engageable with said terminals of said first housing in a fitted condition and an interruption plate cooperable with said single opening, wherein, in said fitted condition, wherein said second associated contact portion maintains engagement with said second terminal while the first associated contact portion is forced by said interruption plate in a direction opposite said common direction to disengage the first associated contact portion from the first terminal.

19. The connector according to claim 18, wherein said interruption plate engages only said first associated contact portion in said fitted condition.

20. A connector comprising:

a housing having terminals, a short circuit terminal having a base fixedly attached to said first housing and resiliently biased adjacent pick-ups for contacting respective ones of said terminals, said pick-ups being biased in substantially a common direction towards said terminals, and means for forcing only one of said pick-ups away from its associated terminal in a direction opposite said common direction while maintaining at least one of another of said pick-ups engaged with its associated terminal.

* * * * *